United States Patent [19]

Ban et al.

[11] Patent Number: 4,967,171

[45] Date of Patent: Oct. 30, 1990

[54] MICROWAVE INTEGRATED CIRCUIT

[75] Inventors: Kazuhiro Ban; Atsuo Ojima, both of Amagasaki, Japan

[73] Assignee: Mitsubishi Danki Kabushiki Kaisha, Tokyo, Japan

[21] Appl. No.: 228,178

[22] Filed: Aug. 4, 1988

[30] Foreign Application Priority Data

Aug. 7, 1987 [JP] Japan ..... 62-198680
Aug. 7, 1987 [JP] Japan ..... 62-198681

[51] Int. Cl.[5] ..... H01P 5/18

[52] U.S. Cl. ..... 333/116; 333/204; 333/246

[58] Field of Search ..... 333/115, 116

[56] References Cited

U.S. PATENT DOCUMENTS 3,506,932 4/1970 Beurrier ..... 333/116
4,150,345 4/1979 Goldman et al. ..... 333/116
4,607,240 8/1986 Isota et al. ..... 333/116
4,823,097 4/1989 Konishi et al. ..... 333/116

FOREIGN PATENT DOCUMENTS 102 1/1987 Japan ..... 333/116
104202 5/1987 Japan ..... 333/116

OTHER PUBLICATIONS

Konishi et al., *A Directional Coupler of a Vertically Installed Planar Circuit Structure,* IEEE Trans. on MTT, vol. 36, No. 6, Jun. 1988, pp. 1057–1063.

Matthaei et al., "Microwave Filters, Impedance-Matching Networks, and Coupling Structures"; McGraw Hill, N.Y., pp. 182–183, 188–191, 778–781, and 788–789.

"Newly Proposed Vertical Installed Planar Circuit and Its Application", Konishi et al., IEEE Trans. on Broadcasting, Mar. 1987.

*Primary Examiner*—Paul Gensler

[57] ABSTRACT

In a microwave integrated circuit, circuit elements such as microstrip coupled lines or interconnecting lines are formed on a separate substrate which is installed vertically between two halves of an input/output transmission-line substrate, or which is installed vertically on the surface of the input/output transmission-line substrate. Microwave integrated circuits with this configuration can be mass-produced at a low cost, can tolerate high applied power levels, and are smaller than conventional microwave integrated circuits.

14 Claims, 13 Drawing Sheets

MICROWAVE INTEGRATED CIRCUIT

BACKGROUND OF THE INVENTION

This invention relates to a microwave integrated circuit which includes signal line patterns that are formed on a ceramic or an other dielectric substrate for creating a device such as a directional coupler.

FIG. 1 shows a directional coupler using microstrip line patterns which appears as FIG. 2-18 and FIG. 2-23(*b*) in Tsushin-Yo Maikuroha Kairo (Microwave Circuits for Communications) published by the Institute of Electronics and Communications Engineers of Japan. This circuit includes a dielectric substrate 1 made of a ceramic or a similar material, microstrip lines 4, 5, and 6 formed on the dielectric substrate 1, and a ground plane 7. The coupling is formed by the microstrip lines 5 and 6. The microstrip lines 4 are transmission lines that connect the microstrip lines 5 and 6 to input/output edge ports 4-1 to 4-4.

FIG. 2 shows another microstrip coupler configuration which appears as FIG. 2-25 in the above mentioned publication as an example of a 3dB directional coupler. The coupled microstrip lines 5 and 6 have an interdigital configuration and are connected by wires 8. One reason for this configuration is to attain a tighter coupling.

These prior-art directional couplers operate as follows. In the example of FIG. 1, as the microwave power input to the edge port 4-1 of the microwave transmission path formed by the ground plane 7 and the microstrip line 4 traverses the coupled strip line 5, part of the power is transferred to the coupled strip line 6 and is transmitted to the edge port 4-2. Most of the remaining power which is not transferred reaches the edge port 4-3. Any desired coupling ratio, hence any desired power output at the edge port 4-2, can be achieved by an appropriate selection of the gap G between the coupled strip lines 5 and 6, the thickness H of the substrate 1, and the width W of the coupled strip lines 5 and 6.

The example of FIG. 2 differs from the example of FIG. 1 only in the disposition of the edge ports numbered 4-1 to 4-4 with the circuit operating similarly. The coupling between the ports 4-1 and 4-2 is 3dB, so 3dB power is also transmitted to the edge-port 4-3.

Next, a bandpass filter will be shown in a further example of the prior art. FIG. 3 illustrates a microstrip coupler configuration, which appears as FIG. 2-85(*b*) in the above-mentioned publication, as an example of a half-wavelength side-to-side coupling filter. The circuit includes an input strip line 11, coupled strip lines 12 to 16, and an output strip line 17. In this bandpass filter, the microwave power input at the edge port 11-1 is supplied from the input strip line 11 to the coupled strip line 12, and is propagated through the series of coupled strip lines 12 to 16 and the output strip line 17 to the output edge port 17-1. The signal thus transmitted from the input port 11-1 to the output port 17-1 contains substantially only those frequency components in the passband of the filter and the frequency components outside the passband are reflected.

A problem with the prior-art directional coupler configurations of FIG. 1 and FIG. 2 is that when tight coupling is required, the gaps between the coupled strip lines must be extremely narrow. In consequence, the design values of the coupling can be attained only by extremely accurate patterning, and the difficulty in achieving extreme accuracy impairs the productivity of the fabrication process.

Another consequence of the narrow gaps between the coupled strip lines is an inability of the circuits to withstand high levels of applied power. A further problem is that the planar arrangement of the coupled strip lines requires the dielectric substrate 1 to have a large surface area.

The preceding problems are also present in devices of FIG. 3, such as filters that use coupled microstrip lines.

SUMMARY OF THE INVENTION

An object of the present invention is to solve the preceding problems by providing a microwave integrated circuit, which includes input and output signal lines and coupled lines, for eliminating the circuit fabrication problems for improving productivity can be improved, for tolerating higher levels of applied power, and for reducing the planar size of the circuit.

A microwave integrated circuit according to this invention includes at least one coupled-line substrate, coupled lines disposed on vertical side faces of the coupled-line substrate, one or more input/output substrates, and input and output signal lines disposed on the upper surfaces of the input/output substrates, with the upper surfaces being substantially perpendicular to the vertical side faces of the coupled-line substrate or substrates. In a microwave integrated circuit with this configuration, the gap between the coupled lines does not have to be extremely narrow, even when tight coupling is required. Moreover, the gap between the coupled lines, which determines the value of the coupling, depends on the thickness of the coupled-line substrate, and the thickness can be easily controlled in the fabrication process for improving the productivity. Furthermore, the planar area of the circuit is reduced because the coupled lines are disposed on the vertical faces of the coupled-line substrate.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE EMBODIMENTS

The embodiments of the invention will be described with reference to the attached drawings.

Figure 4A:
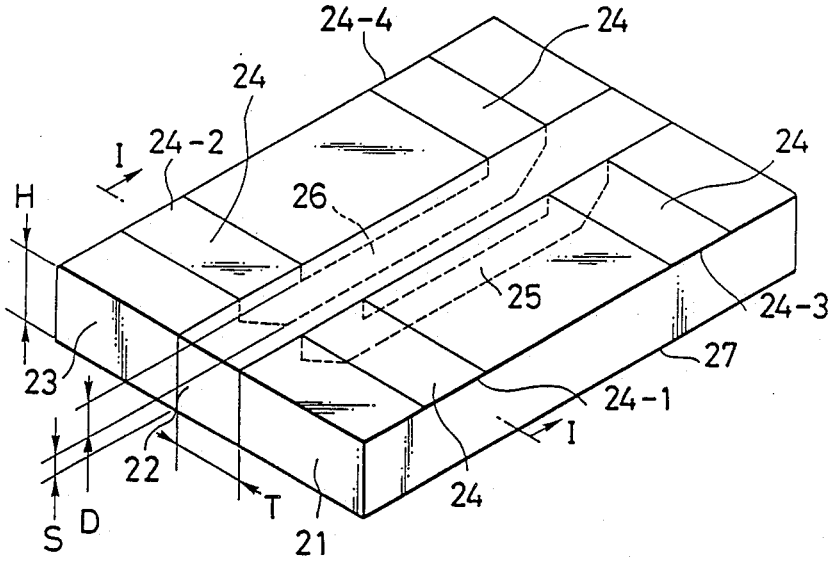
FIGS. 4A and 4B show an oblique view and a sectional view of a directional coupler according to a first embodiment of the present invention.
Figure 4B:
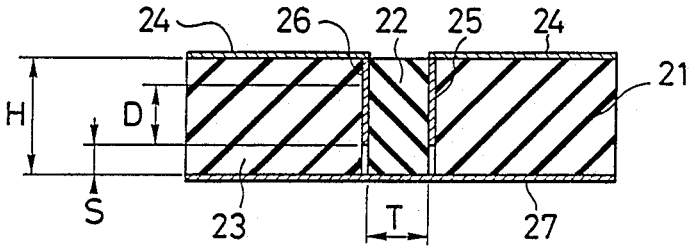

FIG. 4A is an oblique view of a directional coupler fabricated as a microwave integrated circuit according to a first preferred embodiment of this invention. FIG. 4B provides a sectional view along the line I—I. The elements labeled 21 and 23 are input/output substrates, which are dielectric substrates made of, for example, a ceramic material suitable for the formation of planar circuits, having the input and output lines formed on one surface thereof. The element labeled 22 is a coupled-line substrate, which is a dielectric substrate suitable for a vertically-installed circuit, having coupled lines on two opposite vertical faces. The coupled-line substrate 22 can be made of the same material as the substrates 21 and 23, or of a different material which has a higher dielectric constant. The elements labeled 24 are input and output lines consisting of microstrip lines formed on the surfaces of the input/output substrates 21 and 23. The exterior ends of these input and output lines 24 are edge ports 24-1 to 24-4. The elements labeled 25 and 26 are the coupled lines that are patterned on the vertical faces of the coupled-line substrate 22. The element labeled 27 is a ground plane which includes a conductor material.

In this first embodiment, first the coupled lines 25 and 26 are patterned on vertical faces of the coupled-line substrate 22. Next, the input/output substrate 21, the coupled-line substrate 22, and the input/output substrate 23 are joined together. Then, the input and output lines 24 are patterned and connected at their respective interior ends to the coupled lines 25 and 26.

This first embodiment operates as follows. When the microwave power applied to the input edge port 24-1 of the microwave carrier circuit consisting of the ground plane 27 and the microstrip lines 24 passes through the coupled line 25, part of the power is transferred to the coupled line 26 and transmitted to the output edge port 24-2. The remaining power is not transferred and is transmitted to the edge port 24-3. Any desired coupling ratio, hence any desired power output at the edge port 24-2, can be obtained by an appropriate selection of the thickness T of the coupled-line substrate 22, the line width D of the coupled lines 25 and 26, and the distance S between the lower edges of the coupled lines 25 and 26 and the ground plane 27. This first embodiment is particularly effective when an appropriate value for the distance S can be obtained by making the distance $H-(D+S)=0$ from the upper edges of the coupled lines 25 and 26 to the upper surface of the coupled-line substrate 22.

The productivity of the fabrication process of a directional coupler according to this first embodiment can be improved because of the ease with which the gap between the coupled lines can be controlled to obtain the desired coupling ratio. Since the coupled lines are disposed on opposite faces of the coupled-line substrate 22, the gap is controlled simply by controlling the thickness T of the substrate. Furthermore, due to the manner in which the coupling lines face each other, the gap between the coupling lines does not have to be extremely narrow even when tight coupling is required, and the circuit can tolerate higher levels of applied power. Finally, since the coupled lines are formed on the vertical sides of the substrate 22, the planar surface area of the circuit can be reduced so that the circuit occupies less space when the circuit is installed as a component in a microwave apparatus.

Figure 5A:
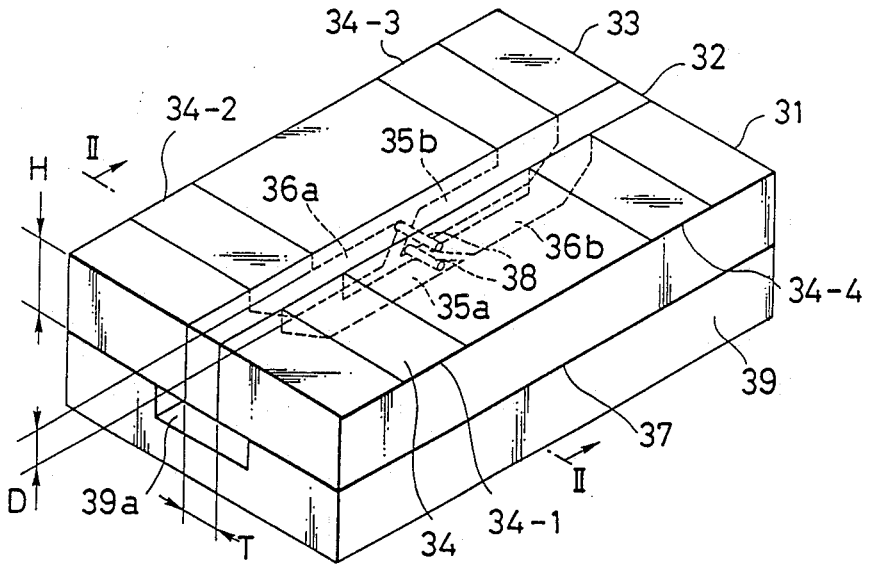
FIGS. 5A and 5B show an oblique view and a sectional view of a directional coupler according to a second embodiment of the present invention.
Figure 5B:
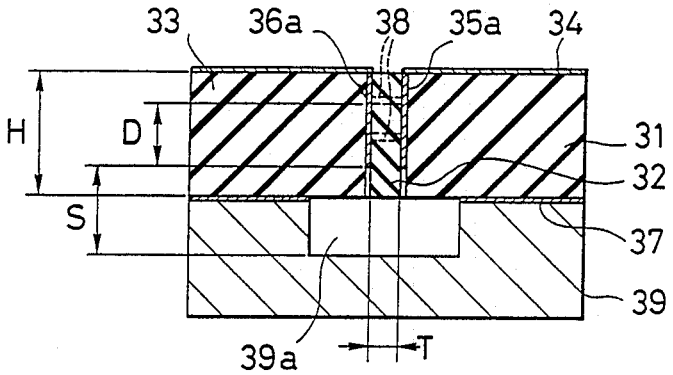

FIG. 5A is an oblique view of a microwave integrated circuit according to a second embodiment of this invention. FIG. 5B is a sectional view along the line II—II. Unlike the first embodiment in FIG. 4A which was suitable for a device with comparatively loose coupling, this second embodiment is suitable for a hybrid circuit providing a tightly-coupled 3dB directional coupler. In a 3dB directional coupler, it is frequently necessary for the two output ports 34-2 and 34-3 to be disposed on the same edge of the device. Accordingly, although the basic configuration of this embodiment is similar to that of the first embodiment in FIG. 4A, the coupled-line substrate 32 has a pair of through-holes 38 via which the coupled lines **35*a* and 36*a* are connected to coupled lines 35*b* and 36*b*** that are located on the opposite side.

This second embodiment also illustrates another feature of a hybrid circuit in which tight coupling is required. Accordingly, the circuit is mounted on a conductive carrier 39 that is provided beneath the substrates 31, 32, and 33, the portion of the ground plane 37 underlying the vicinity of the coupled lines is removed and a concave depression **39*a* is formed in the conductive carrier 39 under the removed portion. Thereby, the distance S from the lower edge of the coupled lines to the ground conductor is enabled to be greater than the vertical distance from the lower edge of the coupled lines to the ground plane 37. Increasing the distance S in this way makes it possible to obtain the desired coupling ratio. In the operation of this second embodiment, the microwave power applied to the input port 34-1 is divided into equal halves, and 3dB is provided to the respective output ports 34-2 and 34-3 which are disposed on the same edge of the device. The port 34-4** is an isolation port to which signal components, such as an unbalance component which results from asymmetry in the fabrication process, is transmitted.

In this second embodiment, the location of the coupled lines **35*a*, 35*b*, 36*a*, and 36*b* on the vertical sides of the coupled-line substrate 32** improves the productivity, the tolerance for higher levels of applied power, and the reduction of the in device size. This second embodiment is particularly effective in raising power tolerances when the coupled lines must be tightly coupled.

Figure 1:
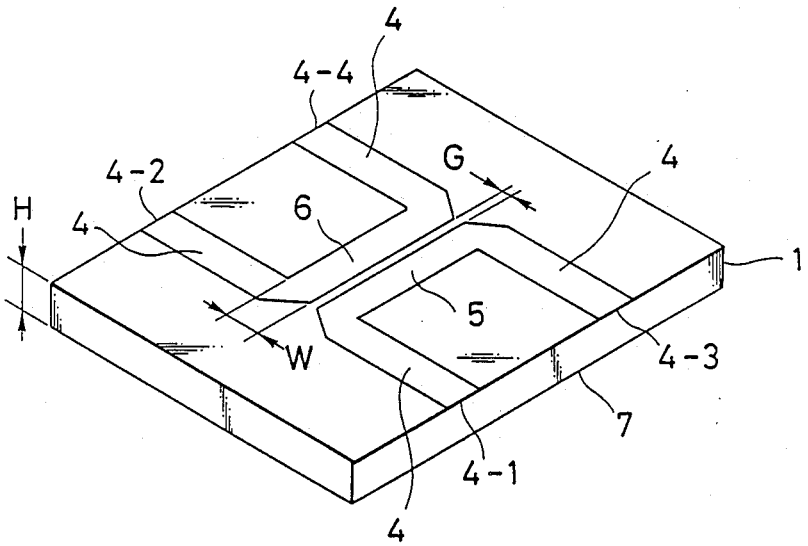
FIG. 1 PRIOR ART
FIGS. 1 and 2 show oblique views of prior-art microwave integrated circuits.
Figure 2:
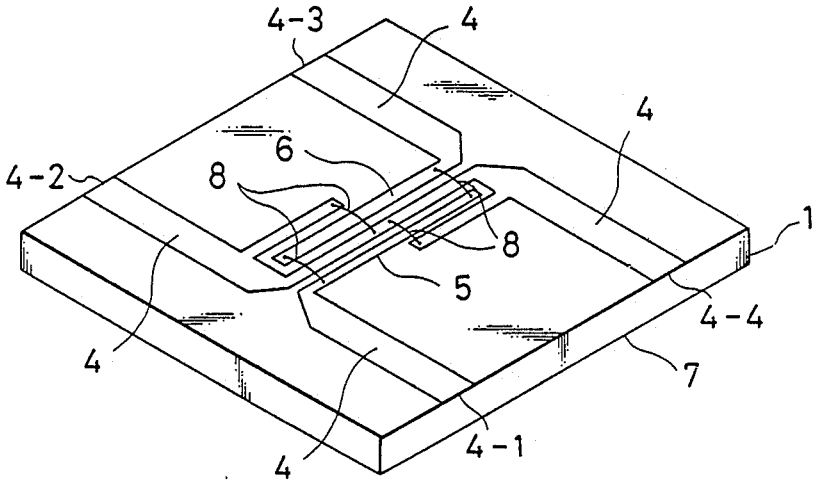
FIG. 2 PRIOR ART
Figure 3:
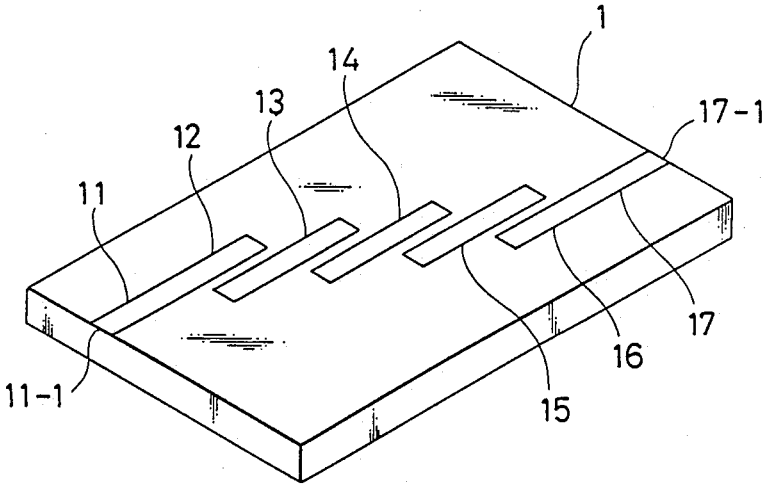
FIG. 3 PRIOR ART
FIG. 3 shows an oblique view of a prior-art bandpass filter.
Figure 6:
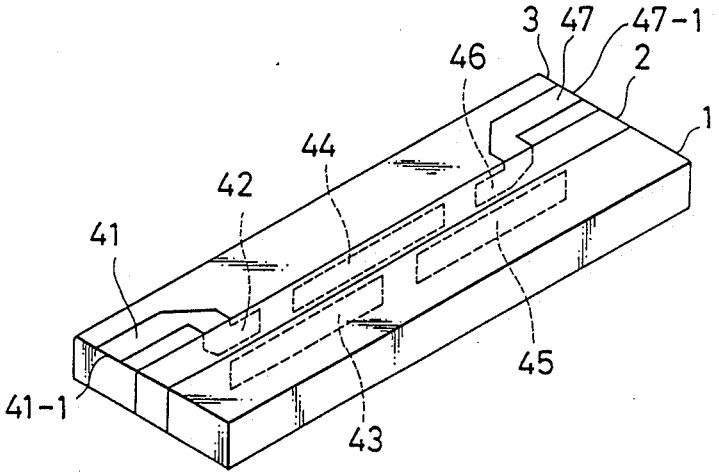
FIG. 6 shows an oblique view of a bandpass filter according to a third embodiment of the present invention.

FIG. 6 shows a bandpass filter implemented as a microwave integrated circuit illustrating a third embodiment of this invention. In this drawing, elements 1, 2, and 3 are dielectric substrates, 41 is an input line, 47 is an output line, and 42 to 46 are coupled lines. This bandpass filter functions similar to the bandpass filter in FIG. 3, which has already been explained.

In a bandpass filter having this structure, even if the desired passband characteristic requires extremely tight coupling, the gap between the coupled lines can be set easily similar to the setting of the directional couplers shown in FIG. 4A and FIG. 5A, and improved productivity results. Tolerance of applied power is also improved, and the device can be reduced in size.

All of the preceding embodiments have a three-part construction in which a single coupled-line substrate is disposed between two input/output dielectric substrates suitable for planar circuits. Additionally, it is possible to construct circuits with similar advantages by adding further coupled-line substrates and input/output substrates.

The coupled-line substrate in all of the first to third embodiments carried coupled lines, but it is possible to form circuit elements other than coupled lines on the vertical faces of the substrate. For example, in a circuit which includes semiconductor elements such as DC blocking capacitors and field-effect transistors, elements are commonly inserted in series on a 50 ohm line for suppressing DC components in microwave integrated circuits, the bias circuits for supplying DC power to these elements, together with choke circuits and other circuit elements, can be formed on the vertical faces of the coupled-line substrate to reduce the size of the device.

Next, a fourth embodiment of the present invention will be described.

Figure 7A:
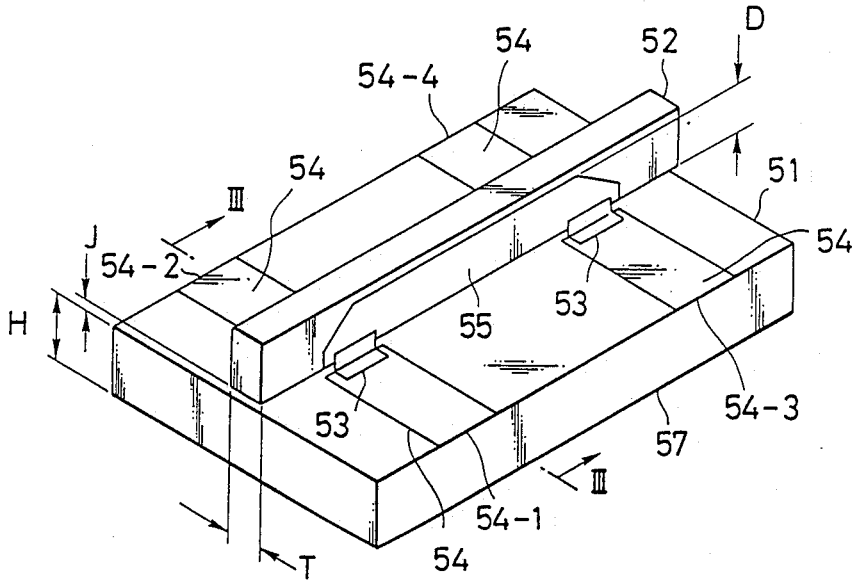
FIGS. 7A and 7B show an oblique view and a sectional view of a directional coupler according to a fourth embodiment of the present invention.
Figure 7B:
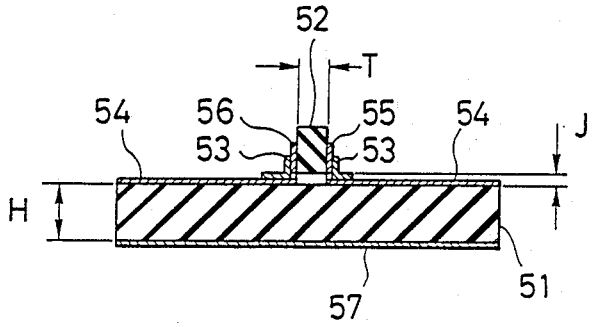

FIG. 7A is an oblique view of a directional coupler implemented as a microwave integrated circuit according to the fourth embodiment of the invention. FIG. 7B is a sectional view along the line III—III. This circuit includes a single input/output substrate 51 and a single coupled-line substrate 52, where both substrates are made of dielectric materials. Microstrip input and output lines 54 are formed on the surface of the input/output substrate 51. Coupled lines 55 and 56 are formed on opposite faces of the coupled-line substrate 52. The input and output lines 54 are connected at one end to the coupled lines 55 and 56 by connectors 53 made of a material such as gold ribbon. The other ends of the input and output lines 54 terminate at edge ports 54-1 to 54-4. A ground plane 57 is located on the lower surface of the input/output substrate 51. The substrates 51 and 52 are joined by the connectors. Thereby, a suitable gap J can be left between the substrates to obtain the desired coupling value, if necessary. The joint between the two substrates can be mechanically secured by inserting a spacer between the two substrates and fastening the spacer with an adhesive, for example.

This fourth embodiment operates as follows. When the microwave power is applied at the input port 54-1 of the microwave transmission circuit which includes the ground plane 57 and the input and output lines 54 passes through the coupled line 55, a portion of the power is transferred to the coupled line 56 and is transmitted to the output port 54-2. The remaining portion of the power that is not transferred is transmitted to the output port 54-3.

The desired coupling ratio at the output port 54-2 can be obtained by a suitable selection of the thickness T of the coupled-line substrate 52, the width D of the coupled lines 55 and 56, and the gap J between the surface of the input/output substrate 51 and the lower edges of the coupled lines 55 and 56.

An example of a method for calculating the values of T (the thickness of the substrate) and D (the width of the coupled lines) is shown below. The following explanation draws on the formulas and values given on pages 182 to 183, 188 to 191, 778 to 781, and 788 to 789 of *Microwave Filters, Impedance-Matching Networks, and Coupling Structures* by G. L. Matthaei et al., published by the McGraw Hill Book Company.

First, the following formulas are known for a directional coupler operating in the TEM mode.

$$C = (Z_{oe}/Z_{oo} - 1)/(Z_{oe}/Z_{oo} + 1) \quad (1)$$

$$Z_o = \sqrt{Z_{oe}Z_{oo}} \quad (2)$$

From these formulas it follows that:

$$Z_{oe} = Z_o\sqrt{(1 + C)/(1 - C)} \quad (3)$$

$$Z_{oo} = Z_o\sqrt{(1 - C)/(1 + C)} \quad (4)$$

where C is the voltage coupling coefficient at the mid-band frequency, $Z_o$ is the characteristic impedance of the lines connected to the input and output ports of the directional coupler, and this characteristic impedance is matched with the impedance of the input and output ports of the coupler.

$Z_{oe}$ and $Z_{oo}$ are the impedances for the even and odd modes of the coupled lines. The required dimensions of the coupled lines can be calculated from the necessary values of $Z_{oe}$ and $Z_{oo}$.

The even-mode and odd-mode impedances $Z_{oe}$ and $Z_{oo}$ are related to the per-unit-length capacitances $C_{oe}$ and $C_{oo}$ in the even and odd modes by the following formulas (from page 182 of the above mentioned reference):

$$\sqrt{\epsilon_r}\, Z_{oe} = 376.6\epsilon/C_{oe} \quad (5)$$

$$\sqrt{\epsilon_r}\, Z_{oo} = 376.6\epsilon/C_{oo} \quad (6)$$

where $\epsilon_r$ is the relative dielectric constant and $\epsilon$ is the dielectric constant.

The per-unit-length capacitances $C_{oe}/\epsilon$ and $C_{oo}/\epsilon$ for general parallel coupled lines in the even and odd modes can be expressed as a sum of the fringing capacitances and the parallel-plate capacitances.

The preceding relationships apply to the present invention as follows.

Figure 11A:
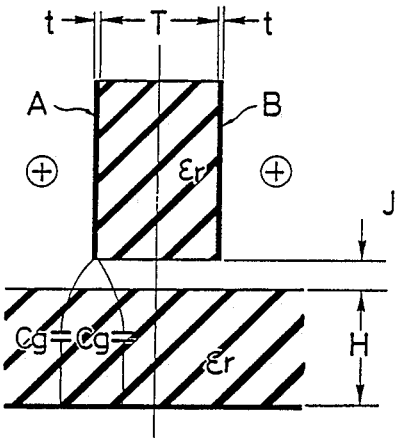
FIGS. 11A and 11B are explanatory drawings describing the operation of the fourth embodiment shown by of FIGS. 7A and 7B, FIGS. 12A and 12B show equivalent circuits of the circuits in FIGS. 11A and 11B, FIGS. 13A, 13B, and 13C show an oblique view and sectional views along the lines IV—IV and V—V of an eighth embodiment of the present invention (with a T-strip configuration)

FIG. 11A shows the even-mode coupling state, in which $C_{oe}/\epsilon$ is related to the fringing capacitance $C_g/\epsilon$ as follows:

$$C_{oe}/\epsilon = 2C_g/\epsilon. \quad (7)$$

Figure 11B:
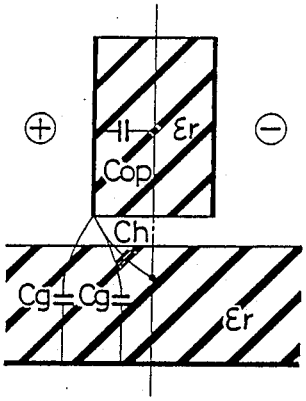

FIG. 11B shows the odd-mode coupling state, in which $C_{oo}/\epsilon$ can be expressed as follows:

$$C_{oo}/\epsilon = C_{op}/\epsilon + C_h/\epsilon + 2C_g/\epsilon. \quad (8)$$

Figure 12A:
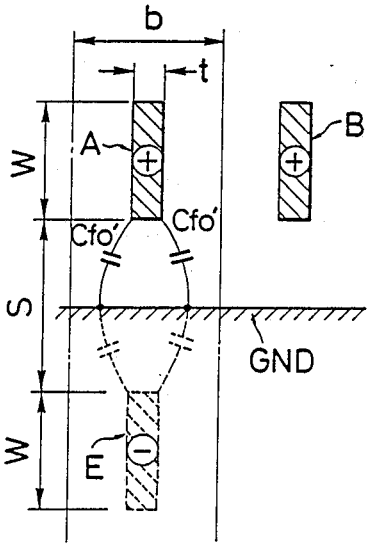
Figure 12B:
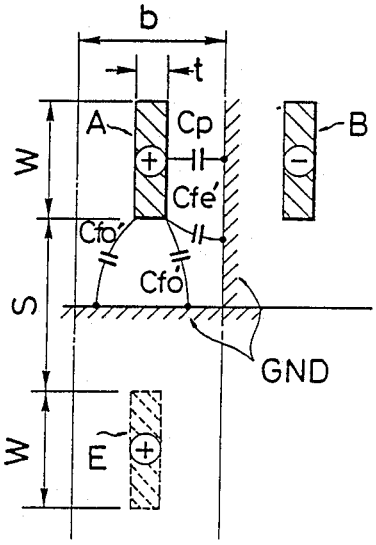

Next, the fringing capacitances $C_g/\epsilon$ and $C_h/\epsilon$ are enabled to be found from fringing capacitances. The values of the fringing capacitances are already known from the calculations, and FIGS. 12A and 12B show equivalent circuit configurations for the even and odd modes. If A and B are the coupled conductors, as is apparent from FIG. 12A, since $C_{oe}/\epsilon$ is the capacitance between the conductor A and the ground conductor GND, the fringing capacitance $C_g/\epsilon$ is equal to the odd-mode fringing capacitance $C'_{fo}/\epsilon$ between the conductor A and an image conductor E located in a symmetrically opposite position to the conductor A with respect to the ground conductor GND (equation 9):

$$C_g/\epsilon = C'_{fo}/\epsilon. \quad (9)$$

From FIG. 12B it is apparent that since $C_{oo}/\epsilon$ is the capacitance between the conductor A and the ground conductor GND, the fringing capacitance $C_h/\epsilon$ is equal to the even-mode fringing capacitance $C'_{fe}/\epsilon$ between the conductor A and the image conductor E (equation 10).

$$C_h/\epsilon = C'_{fe}/\epsilon \quad (10)$$

The parallel-plate capacitance $C_{op}/\epsilon$ in FIG. 11B equals $C_p/\epsilon$ from FIG. 12B. Using the parameters in FIG. 12B, as indicated on page 191 of the above mentioned reference, the parallel-plate capacitance can be expressed as $C_p/\epsilon = 2W/(b-t)$.

Substitution of equations (9) and (10) into equations (7) and (8) gives the following relationships:

$$C_{oe}/\epsilon = 2C_g/\epsilon = 2C'_{fo}/\epsilon \quad (11)$$

$$C_{oo}/\epsilon = C_{op}/\epsilon + C_h/\epsilon + 2C_g/\epsilon = C_p/\epsilon + C'_{fe}/\epsilon + 2C'_{fo}/\epsilon. \quad (12)$$

Using the parameters t, S, and b in FIGS. 12A and 12B, it is possible to determine $C'_{fe}/\epsilon$ and $C'_{fo}/\epsilon$ from well-known data (shown at the graph on pages 188 and 189 of the above-mentioned reference). Therefore, it is possible to calculate $C_{oe}/\epsilon$ and $C_{oo}/\epsilon$.

Next an example of the application of the present invention will be described with reference to actual numerical calculations based on the design formulas derived above.

First the example of a 3dB directional coupler employing a ceramic substrate ($\epsilon_r = 9.8$ to 10.2) of the type most frequently used in microwave integrated circuits will be described. The characteristic impedance $Z_o$ will be assumed to be 50 ohms.

Letting C be the voltage coupling ratio, since the coupling in equation (1) is 3dB, C is calculated as follows:

$$3(\text{dB}) = -20\log_{10}C$$

$$\therefore C = 0.708.$$

From equations (3) and (4):

$$Z_{oe} = Z_o\sqrt{(1+C)/(1-C)} = 120.9 \text{ (ohms)}$$

$$Z_{oo} = Z_o\sqrt{(1-C)/(1+C)} = 20.67 \text{ (ohms)}.$$

From equations (5) and (6) with $\epsilon_r = 10.2$:

$$C_{oe}/\epsilon = 376.6/(Z_{oe}\sqrt{\epsilon_r}) = 0.9737$$

$$C_{oo}/\epsilon = 376.6/(Z_{oo}\sqrt{\epsilon_r}) = 5.7064.$$

From equation (11):

$$C_{oe}/\epsilon = 2C_g/\epsilon = 2C'_{fo}/\epsilon$$

$$\therefore C'_{fo}/\epsilon \approx 0.49.$$

This value of $C'_{fo}/\epsilon$ will be used to obtain values of the parameters b, t, and S in FIG. 12A (as described on page 189 in the preceding reference). The gap J is assumed to be 0. The value of $C'_{fo}/\epsilon$ becomes constant under the following conditions:

$t/b = 0$ and $S/b = 0.83$ (approximately)

$t/b = 0.025$ and $S/b > 1.5$ (approximately).

Since t cannot be 0, let it be assumed that $t/b = 0.025$. Then the following parameters, for example, satisfy the above conditions and give $C'_{fo}/\epsilon = 0.49$:

$t = 0.006$ mm, $b = 0.25$ mm, $S > 0.38$ mm.

Next, the value of W will be derived from equation (12) and the values given on page 188 of the above-mentioned reference.

$$C_{oo}/\epsilon = C_p/\epsilon + C'_{fe}/\epsilon + 2C'_{fo}/\epsilon = 5.7064$$

$$\therefore C_p/\epsilon + C'_{fe}/\epsilon = 4.7327$$

From the value of $C_{oe}/\epsilon$, if $S > 0.38$, the thickness of the ceramic substrate can be 0.635 mm, which is a standard thicknesses for ceramic substrate materials, and S can be given the value $S = 0.635 \times 2 = 1.27$.

When $t/b = 0.025$, if $S/b = 1.27/0.25 = 5.08 > 1.5$ (from page 188 in the above mentioned reference), $C'_{fe}/\epsilon = 0.48$. Thus:

$$C_p/\epsilon = 4.7327 - 0.48 = 4.2527$$

Since $C_p/\epsilon = 2W/(b-t)$:

$$W = [C_p/\epsilon]\cdot[(b-t)/2] = 0.5181 \text{ (mm)}.$$

Figure 8:
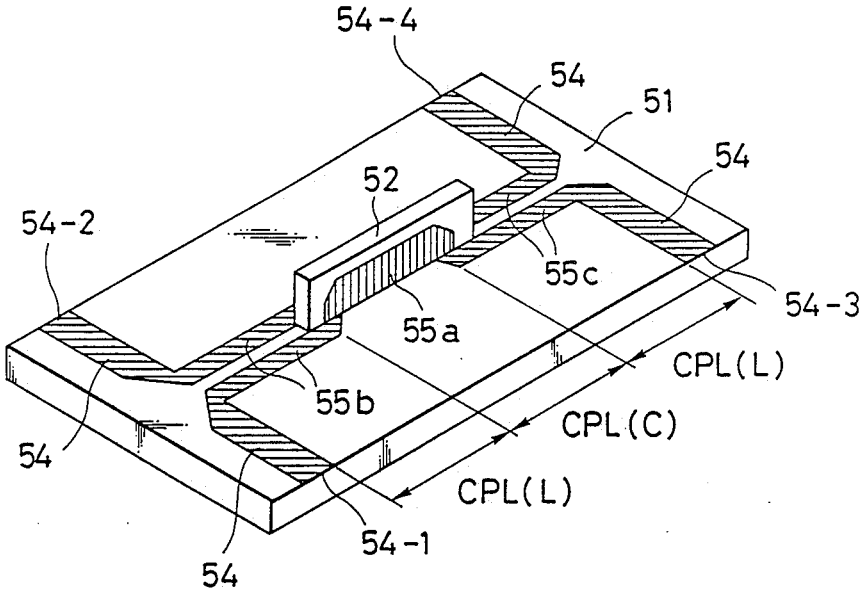
FIGS. 8 to 10 are oblique views illustrating fifth to seventh embodiments of the present invention.

This concludes the discussion for the fourth embodiment in FIGS. 7A and 7B. Next the fifth embodiment, as shown in FIG. 8, will be described on the base of the above discussion.

Apparatus, such as devices for electronic countermeasures (ECM), require a variety of microwave devices capable of a broadband operation in excess of one octave. In particular, 3dB directional couplers are essential as hybrid circuits in apparatus such as balanced FET amplifiers. There is an urgent need for broadband devices of this type.

A three-section directional coupler provides the best-known method of obtaining a broadband device. As an example of an application of this invention, calculations will be described for a three-section 3dB directional coupler with ±0.2dB ripple.

The coupling coefficient $C_2$ in the second of the three coupler sections is assumed to be $C_2 = 0.8405$ (from the table on page 789 of the above-mentioned reference). Then, because $20\log C_2 = -1.51$, a tightly-coupled −1.51dB directional coupler is obtained. From equations (3) and (4):

$$Z_{oe} = Z_o\sqrt{(1+C_2)/(1-C_2)} = 169.8 \text{ (ohms)}$$

and $$Z_{oo} = Z_o\sqrt{(1-C_2)/(1+C_2)} = 14.7 \text{ (ohms)}.$$

From equations (5) and (6):

-continued $$C_{oe}/\epsilon = 376.6/Z_{oe}\sqrt{\epsilon_r} = 0.68$$

and $$C_{oo}/\epsilon = 376.6/Z_{oo}\sqrt{\epsilon_r} = 8.01.$$

From equation (11):

$$C_{oe}/\epsilon = 2C'_{fo}/\epsilon = 0.69 \text{ and}$$

$$\therefore C'_{fo}/\epsilon = 0.34.$$

As shown on page 189 of the preceding above-mentioned reference, regardless of the values of t/b and S/b, $C'_{fo}/\epsilon$ is always approximately 0.44 or greater. Thereby, $C'_{fo}/\epsilon < 0.44$ is unattainable because a large value of 10.2 being used for $\epsilon_r$. A major feature of this embodiment is that it enables the effective dielectric constant $\epsilon_{eff}$ in the even mode to be reduced by a gap J provided between the substrate for the coupled lines and the substrate for the input and output lines.

Furthermore, capacitance is inversely proportional to the distance between the electrodes and the directly proportional to the dielectric constant. The even-mode fringing capacitance $C_g$ includes an air capacitance ($\epsilon_r = 1$) and the capacitance of a dielectric body ($\epsilon_r = 10.2$) connected in series, so the effective dielectric constant is:

$$\epsilon_{eff} = \epsilon_r(1 + G/H)/(1 + \epsilon_r G/H). \quad (13)$$

If the conductor thickness in FIG. 11A is t=0.005 mm and the coupling substrate is a standard ceramic substrate with a thickness of T=0.127 mm, the effective dielectric constant $\epsilon_{eff}$ that gives the desired even-mode impedance $Z_{oe}$ can be calculated as follows. From FIG. 12A and 11A, t/b can be regarded as t/(T+t):

$$t/b = t/(T+t) \approx 0.038.$$

If $S/b \geqq 1.5$, $C'_{fe}/\epsilon = 0.51$ approximately, so from equation (11), $C_{oe}/\epsilon = 2C'_{fo}/\epsilon = 1.02$. Substituting this value into equation (5):

$$\sqrt{\epsilon_{eff}} = 376.6/(Z_{oe}\, C_{oe}/\epsilon) = 2.1744$$

$$\therefore \epsilon_{eff} = 4.725.$$

By substituting this value into equation (13), it is possible to find G/H, that is, the gap J by the equation.

$$G/H = (1 - \epsilon_{eff}/\epsilon_r)/(\epsilon_{eff} - 1) = 0.144.$$

If the thickness of the substrate for the input and output lines is H=0.4 mm, then G=0.057 mm.

Next the value of W in the odd mode can be calculated from equation (12) by the same method as for a 3dB directional coupler. Thereby:

$C'_{fe}/\epsilon = 0.50$;

$C_p/\epsilon = 6.5$;

$C_p = 2W/(b-t)$; and

W=0.412 (mm)

The preceding calculations are approximate calculations used for the purpose of explaining the present invention. In more precise calculations, the effect of the gap J would also be included in the calculation of the fringing capacitance $C'_{fe}/\epsilon$.

Next, the case of the two outer sections of a three-section directional coupler will be described. The coupling ratio of the first section is $C_1 = 0.18367$ (from the table on page 789 of the above-mentioned). This is a loose directional coupling with $20\log C_1 = -14.72$ (dB), and the configuration of this invention would give $C_p/\epsilon < 0$, which is impossible. For the loosely-coupled sections, the design uses a microstrip coupling of a conventional design.

Finally, the question of the length of for the coupled lines will be considered. The capacitance $C_{oe}$ in the even mode consists only of the fringing capacitance $C_g$ in FIG. 11A, so the wavelength can be calculated using the effective dielectric constant given by equation (13). In the odd mode, as can be seen from FIG. 11B, the capacitance $C_{oo}$ includes $C_g$ and $C_h$, which are affected by the gap J, and $C_{op}$ which is not affected by the gap J, so the length should lie approximately between the wavelength determined by the dielectric constant of the substrate $\epsilon_r$ and the wavelength of the odd mode. For the length of the coupled lines of the coupler, a value between the wavelengths in the even and odd modes is taken as the wavelength, and ¼ of this value is used as the length of the coupled lines in the central tightly-coupled part.

Examples have been shown of methods for calculating the spacing, width, and length of the coupled lines. Next, further embodiments of the invention will be described.

FIG. 8 shows a fifth embodiment which has a three-section directional coupler. The elements are identical to the corresponding elements in FIG. 7A and are labeled with the same reference numerals. The coupled lines **55*a* in the fifth embodiment of FIG. 8 are located in the section labeled CPL(C). The difference between the fifth embodiment and the fourth embodiment of FIG. 7A is the presence of the loosely-coupled lines labeled 55*b* and 55*c*** in the sections labeled CPL(L). Aside from this difference, the fifth embodiment operates in the same way as the fourth embodiment of FIG. 7A, so a further description is omitted.

Figure 9:
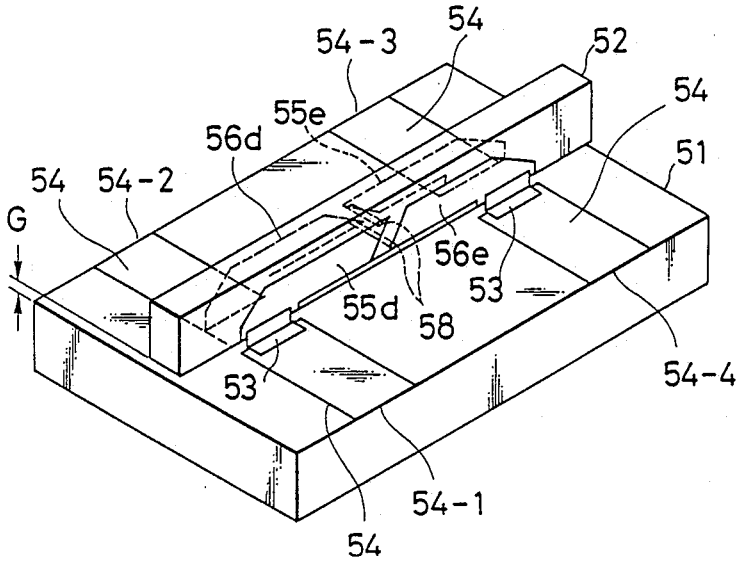

FIG. 9 shows a sixth embodiment having a modification of the fourth embodiment in FIG. 7A. The elements are identical to the elements in FIG. 7 and are labeled with the same reference numerals. The difference between the sixth embodiment in FIG. 9 and the fourth embodiment in FIG. 7A is that the locations of the output ports 54-3 and 54-4 have been switched, and through-holes 58 have been formed in the center of the coupled lines **55*d* and 56*d*** to permit them to cross over.

Figure 10:
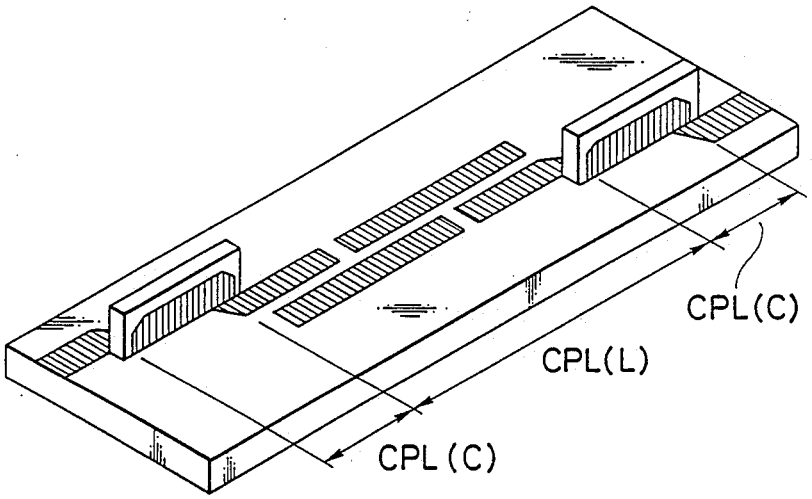

FIG. 10 shows a seventh embodiment of a bandpass filter having a modification of the fourth embodiment in FIG. 7A. The loosely-coupled portion in the center labeled CPL(L) includes microstrip lines. The tightly-coupled portions labeled CPL(C) at the two ends have the coupling configuration according to this invention.

The fourth to seventh embodiments in FIGS. 7 to 10 all use separate substrates for the input, output, and coupled lines and for the thereby making it easy to fabricate tightly-coupled directional couplers. Such tightly coupled directional couplers would be impractical to fabricate by conventional methods using microstrip lines because of the extremely high pattern accuracy that would be required.

This invention can also be applied to coplanar microwave integrated circuits as shown in FIGS. 13A, 13B, and 13C, FIGS. 14A and 14B, and FIGS. 15A and 15B.

Figure 13A:
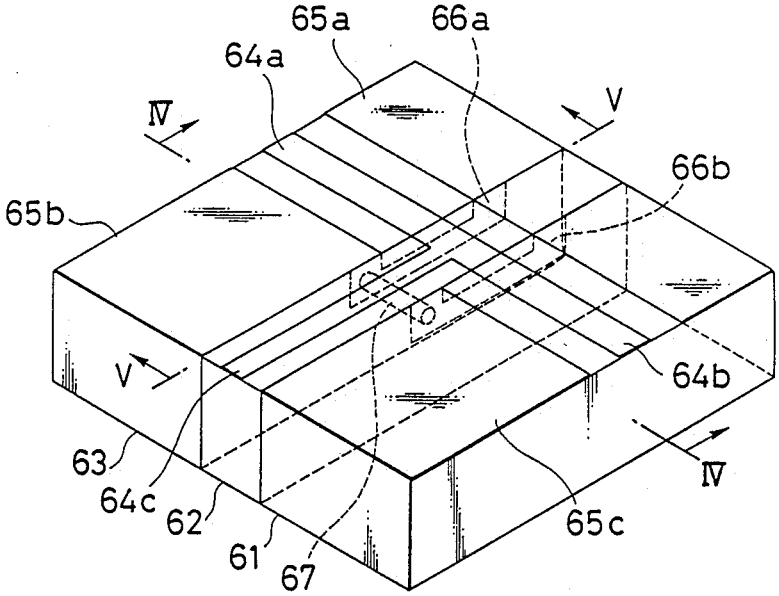
Figure 13B:
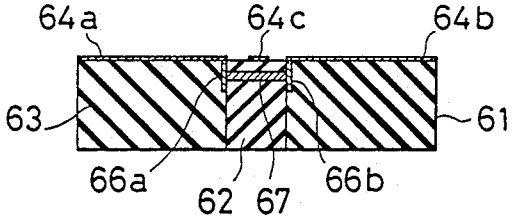
Figure 13C:
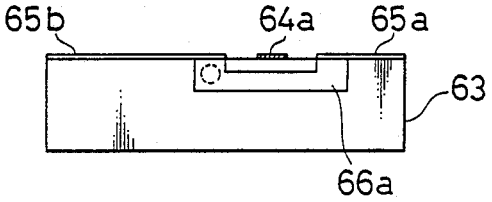

FIG. 13A shows an oblique view of a microwave integrated circuit according to an eighth embodiment of this invention, FIG. 13B shows a sectional view along the line IV—IV, and FIG. 13C shows a sectional view along the line V—V. The circuit includes a pair of dielectric substrates 61 and 63 for planar circuits which are formed on the surfaces of the substrates 61 and 63, a dielectric substrate 62 for vertical circuits which are formed on vertical faces of the substrate 62, signal lines 64*a*, 64*b*, and 64*c*, three ground plane portions 65*a*, 65*b*, and 65*c*, ground lines 66*a* and 66*b* which are patterned before the substrate 62 is joined to the substrates 61 and 63, and a through-hole 67 which connects the ground lines 66*a* and 66*b*.

The signal lines 64*a*, 64*b*, and 64*c* form a parallel branching circuit that divides the ground plane into three parts labeled 65*a*, 65*b*, and 65*c* which must be interconnected. In this eighth embodiment, after the ground lines 66*a* and 66*b* are formed on the substrate 62 and the through-hole 67 is formed through the interior of the substrate 62, the coupled-line substrate 62 is joined to the substrates 61 and 63. Next, when the three portions of the ground plane 65*a*, 65*b*, and 65*c* are formed by epitaxial growth and by patterning on the substrates 61, 62, and 63, the ground lines 66*a* and 66*b* and the through-hole 67 establish mutual interconnections among all portions of the ground plane.

Figure 16:
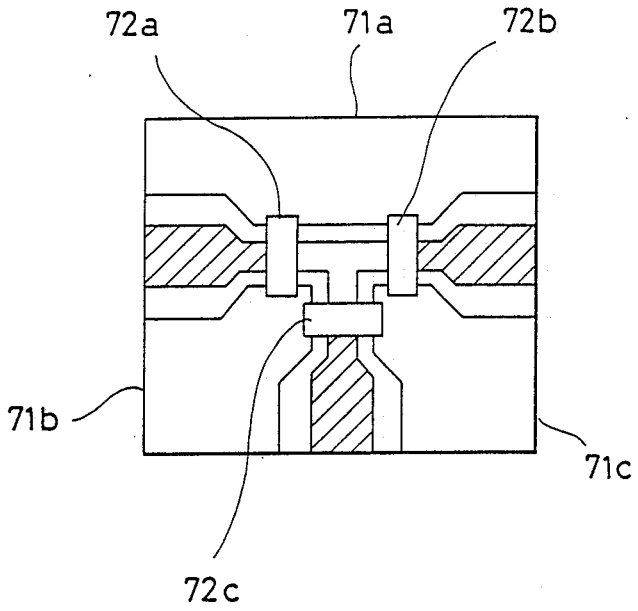
FIG. 16 PRIOR ART
FIG. 16 is a plan view showing a prior-art T-strip microwave integrated circuit.

In the fabrication of the microwave circuit having this configuration, patterning and through-hole formation processes are performed on the substrate 62 for the vertical circuit prior to the creation of the ground lines 66*a* and 66*b* and the through-hole 67. No process is therefore required to interconnect the portions of the ground planes after they have been formed. In contrast to this, in the prior art as shown, for example, in FIG. 16, the three ground plane portions 71*a*, 71*b*, and 71*c* must be interconnected by three air bridges 72*a*, 72*b*, and 72*c*. The creation of the air bridges require a complex process which includes formation of an insulating layer, patterning of the insulating layer, formation of a conductor layer on the insulating layer, and patterning of the conductor layer. Microassembly work is also required, so that productivity is low which makes it difficult to obtain uniform characteristics. If the eighth embodiment in FIG. 13A is used, the fabrication process is simple and easy to carry out, which enables microwave integrated circuits to be produced at a low cost.

Figure 14A:
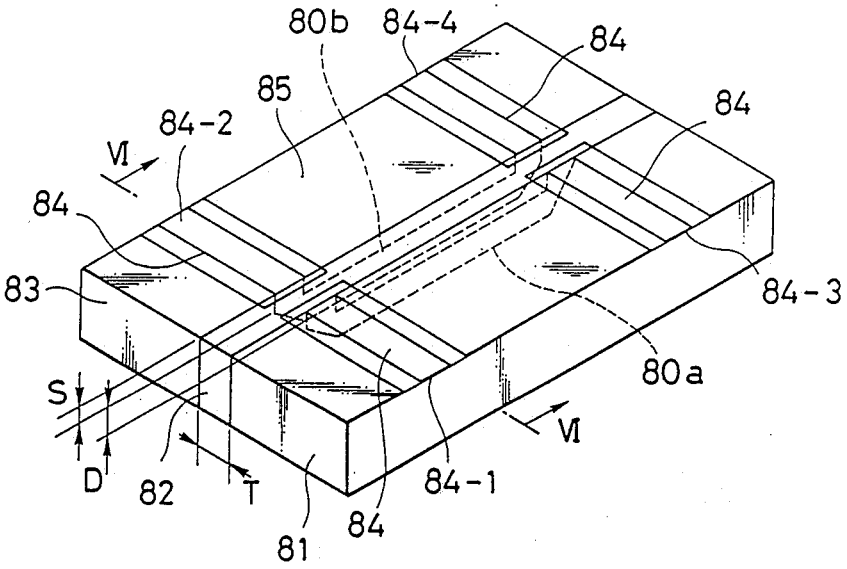
FIGS. 14A and 14B show an oblique view and a sectional view of a ninth embodiment of the present invention.
Figure 14B:
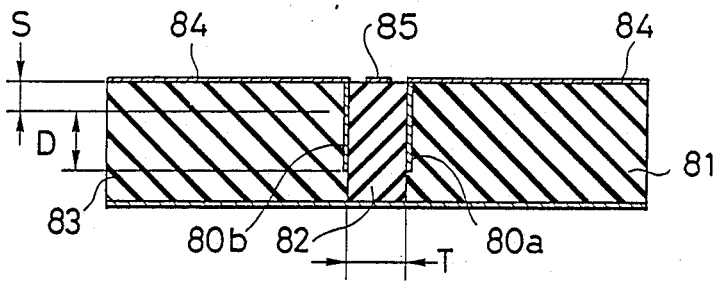

FIG. 14A shows an oblique view of a directional coupler using coplanar lines according to another a ninth embodiment of this invention. FIG. 14B shows a sectional view along the line VI—VI. This ninth embodiment includes a central coupled-line substrate 82 having coupled lines 80*a* and 80*b* formed on the vertical faces thereof, and a pair of input/output substrates 81 and 83 having transmission lines 84 and a ground plane 85 formed on the upper surface thereof, with the ground plane 85 being coplanar with the transmission lines 84. The transmission lines 84 terminate at input-/output edge ports 84-1 to 84-4 at one end, and are connected at their other ends to the coupled lines 80*a* and 80*b*. The desired coupling ratio can be achieved by an appropriate selection of the thickness T of the coupled-line substrate 82, the distance S from the upper surface of the coupled-line substrate 82 to the upper edges of the coupled lines 80*a* and 80*b*, and the width D of the coupled lines 80*a* and 80*b*. When a signal is applied to the edge port 84-1, the coupled signal is obtained at the edge port 84-2 and the through-signal remaining after the coupling is obtained at the edge port 84-3. The edge port 84-4 functions as an isolation port.

In a directional coupler with this configuration, the coupled lines 80*a* and 80*b* are formed on the vertical faces of the substrate 82 for the vertical circuit and thus, are buried in the interior of the device. The ground plane 85 can be formed as a single connected plane on the surface of the device, so no complex interconnection process is required for the ground, enabling the directional coupler to be produced at a low cost.

Figure 15A:
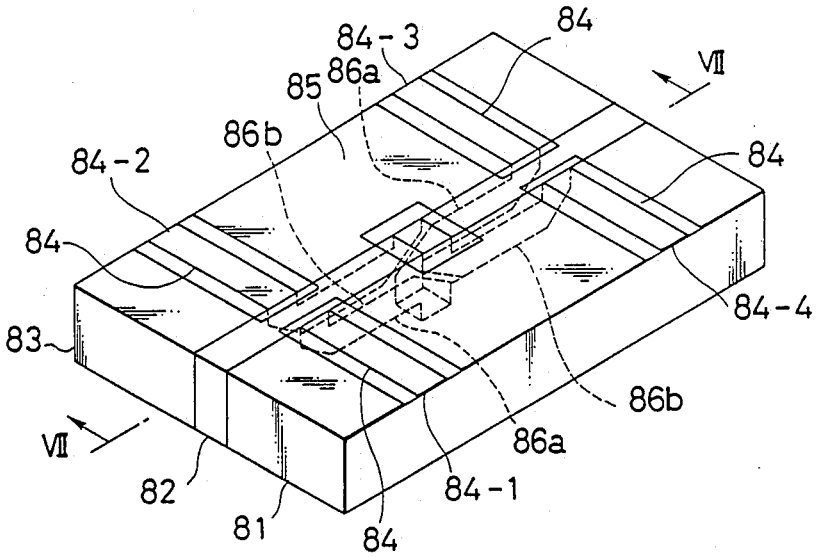
FIGS. 15A and 15B show an oblique view and a partly-cutaway oblique view of a tenth embodiment of the present invention.
Figure 15B:
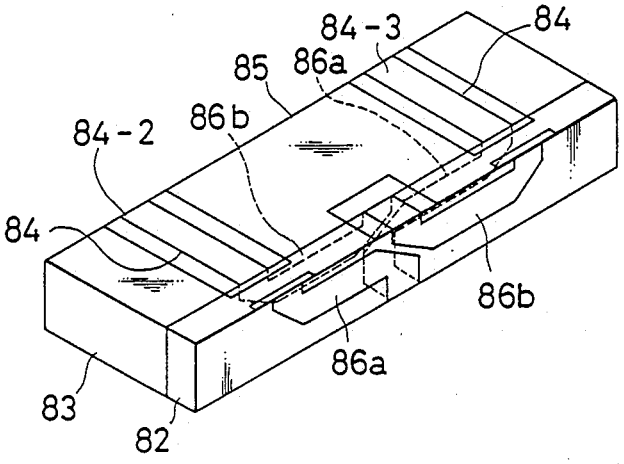

FIG. 15A shows an oblique view for a tenth embodiment of a microwave integrated circuit having a modification of the ninth embodiment in FIG. 14A. FIG. 15B shows a cutaway view along the line VII-VII. This circuit is a hybrid coplanar circuit that functions as a 3dB directional coupler. The purpose of this tenth embodiment is to enable the output port 84-2 and the through-port 84-3 to be located on the same edge of the device, which is generally desirable in a hybrid circuit. In this tenth embodiment, the coupled lines 86*a* and 86*b* formed on the vertical faces of the coupled-line substrate 82 cross over on the upper and lower surfaces of the coupled-line substrate 82 near the center. Thereby, the substrate is joined to the input/output substrates 81 and 83, and the circuit patterns formed on the substrates are connected diagonally to opposite edge ports. In this tenth embodiment, it is not necessary to form through-holes during the fabrication of the coupled-line substrate 82 because the crossover is completed by the line patterns on the upper and lower surfaces. To avoid a short circuit, a nonconductive margin is left around the crossover portion, between the crossover portion and the ground plane 85. In this tenth embodiment, unlike the ninth embodiment in FIG. 14A having the coupled lines 80*a* and 80*b* being entirely buried in the interior of the device, the crossover part of the coupled lines 86*a* and 86*b* is exposed on the surface of the device.

In a 3dB direction coupler with this configuration, the coupled lines 86*a* and 86*b* are entirely disposed on the faces of the coupled-line substrate 82. Thereby, the fabrication process is simple and easy to carry out, and the 3dB coupler can be produced at a low cost.

In the eighth to tenth embodiments shown in FIGS. 13 to 15, integrated circuits are illustrated which include a central substrate disposed between two side substrates, although the ground plane is dissected by the transmission lines (or vice versa) on the surface of the device. The dissected portions are connected by interconnection lines created on the sides of the central substrate, so that a separate interconnection process is not necessary to interconnect the separated parts of the ground plane. In consequence, the microwave integrated circuits can be mass-produced at a low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microwave integrated circuit comprising:

first and second input/output substrates, respectively, having a top surface and a side surface adjacent to said top surface;

a plurality of input/output lines disposed on said top surfaces of said first and second input/output substrates;

a coupled-line substrate having first and second side surfaces and a top surface adjacent to said first and second side surfaces, and being disposed between said side surfaces of said first and second input/output substrates; and first and second planar coupled lines being coupled to each other and disposed on said first and second side surfaces of said coupled-line substrate, said first and second planar coupled lines connected to said plurality of input/output lines;

wherein said first and second side surfaces of said coupled-line substrate having said first and second planar coupled lines formed thereon are, respectively, contacted with said first and second input/output substrates so that said top surface of said coupled line substrate is coplanar with said top surfaces of said first and second input/output substrates and said first and second side surfaces of said coupled-line substrate are substantially perpendicular to said top surfaces of said first and second input/output substrates having said plurality of input/output lines formed thereon.

2. A microwave integrated circuit according to claim 1, wherein said first and second input/output substrates each comprise first and second edge ports, and said first and second edge ports are connected to said plurality of input/output lines.

3. A microwave integrated circuit according to claim 1, wherein:

said first and second input/output substrates each comprise first and second edge ports;

said coupled-line substrate comprises first and second through-holes for joining said first and second side surfaces of said coupled line substrate having said first and second planar coupled lines formed thereon;

said first and second planar coupled lines of said coupled-line substrate each comprise first and second input/output lines; and said first and second planar coupled lines are respectively connected via said first and second through-holes.

4. A microwave integrated circuit according to claim 3, further comprising a carrier conductor disposed on bottom surfaces opposite to said top surfaces of said first and second input/output substrates and said coupled-line substrate, said carrier conductor having a concave depression below said coupled-line substrate.

5. A microwave integrated circuit according to claim 1, wherein said first and second input/output substrates and said coupled-line substrate are made of dielectric materials.

6. A microwave integrated circuit comprising:

first and second input/output substrates, respectively, having a top surface and a side surface adjacent to said top surface;

first and second input/output lines disposed on said top surface of said first input/output substrates;

a coupled line substrate having first and second side surfaces and a top surface adjacent to said first and second side surfaces, and being disposed between said side surfaces of said first and second input/output substrates;

first and second planar coupled lines disposed on said first side surface of said coupled line substrate and connected to said first and second input/output lines, respectively, and a third planar coupled line disposed on said first side surface of said coupled line substrate between said first and second planar coupled lines; and fourth and fifth planar coupled lines disposed on said second side surface of said coupled line substrate and coupled to said first, second, and third planar coupled lines;

wherein said first and second side surfaces of said coupled line substrate having said first, second, third, fourth, and fifth planar coupled lines formed thereon are contacted with said first and second input/output substrates so that said top surface of said coupled line substrate is coplanar with said top surfaces of said first and second input/output substrates and said first and second side surfaces of said coupled line substrate are substantially perpendicular to said top surfaces of said first and second input/output substrates having said first and second input/output lines formed thereon.

7. A microwave integrated circuit comprising:

an input/output substrate made of a dielectric material;

a ground plane disposed on a bottom surface of said input/output substrate;

a plurality of input/output lines disposed on a top surface of said input/output substrate;

a coupled-line substrate made of a dielectric material, said coupled-line substrate having a bottom surface being disposed above said top surface of said input/output substrate and first and second side surfaces adjacent to said bottom surface;

first and second planar coupled lines being coupled to each other and disposed on said first and second side surfaces of said coupled-line substrate, and said first and second planar coupled lines being connected to said plurality of input/output lines; and a plurality of connectors made of a conductor material connecting said first and second planar coupled lines with said plurality of input/output lines;

wherein said plurality of connectors have side surfaces being substantially perpendicular to said top surface of said input/output substrate having said plurality of input/output lines disposed thereon, said first and second side surfaces of said coupled-line substrate having said first and second planar coupled lines formed thereon are substantially perpendicular to said top surface of said input/output substrate having said plurality of input/output lines formed thereon, said first and second planar coupled lines of said coupled-line substrate are joined to said side surfaces of said plurality of connectors and said input/output substrate being separated by a predetermined distance from said coupled-line substrate to form a separation region where the dielectric constant of said separation region is less than the dielectric constants resulting from said dielectric materials for said input/output substrate and said coupled-line substrate.

8. A microwave integrated circuit according to claim 7, wherein said separation region comprises air.

9. A microwave integrated circuit according to claim 7, wherein a loosely-coupled portion comprises a plurality of coupled lines formed by a plurality of microstrip lines on said top surface of said input/output substrate and a tightly-coupled portion comprises said plurality of coupled lines formed on said first and second side surfaces of said coupled-line substrate.

10. A microwave integrated circuit comprising:

first and second input/output substrates, respectively, having a top surface and a side surface adjacent to said top surface;

an interconnection substrate having first and second side surfaces and a top surface adjacent to said first and second side surfaces and being disposed between said side surfaces of said first and second input/output substrates;

a ground plane structure disposed on said top surfaces of said first and second input/output substrates and said interconnection substrate;

signal line circuitry formed on said ground structure and dividing said ground structure into first, second, and third portions; and ground interconnection circuitry having first and second ground lines formed on said first and second side surfaces of said interconnection substrate for connecting said first and third portions and said second and third portions of said ground structure respectively and a through-hole for connecting said first and second ground lines so that said first, second and third portion of said ground structure are mutually interconnected;

wherein said first and second side surfaces of said interconnection substrate having said first and second ground lines are substantially perpendicular to said top surfaces of said first and second input/output substrates and said interconnection substrate and said side surfaces of said input/output substrates are contacted with said first and second side surfaces of said interconnection substrate so that said top surfaces of said first and second input/output substrates are coplanar with said top surface of said interconnection substrate.

11. A microwave integrated circuit according to claim 10, wherein said signal line circuitry is formed in a T-configuration on said first and second input/output substrates and said interconnection substrate for dividing said ground structure into said first, second, and third portions.

12. A microwave integrated circuit according to claim 10, wherein said first and second input/output substrates and said interconnection substrate are made of dielectric materials.

13. A microwave integrated circuit comprising:

first and second input/output substrates made of a dielectric material, respectively, having a top surface and a side surface adjacent to said top surface;

an interconnection substrate made of a dielectric material having first and second side surfaces adjacent to top and bottom surfaces and disposed between said side surfaces of said first and second input/output substrates;

a ground structure formed in a pattern on substantially the entire top surfaces of said first and second input/output substrates and said interconnection substrate having first, second, third, and fourth unpatterned portions;

first, second, third, and fourth transmission lines formed on said first, second third, and fourth unpatterned portions of said first and second input/output substrates;

first, second, third, and fourth edge ports formed on said first and second input/output substrates and said first, second, third, and fourth edge ports being connected to said first, second, third, and fourth transmission lines, respectively; and planar interconnection circuitry formed on said first and second side surfaces of said interconnection substrate for interconnecting said first and second transmission lines formed along said first side surface and said third and fourth transmission lines formed along said second side surface;

said first and second side surfaces having said planar interconnection circuitry being substantially perpendicular to said top surfaces of said first and second input/output substrates and said interconnection substrate and said side surfaces of said first and second input/output substrates are contacted with said first and second side surfaces of said interconnection substrate so that said top surfaces of said first and second input/output substrates are coplanar with said top surface of said interconnection substrate.

14. A microwave integrated circuit according to claim 13, wherein said planar interconnection circuitry formed on said interconnection substrate comprises a first interconnecting line extending substantially across a half of said first side surface extending down to said bottom surface and up to said second side surface for diagonally interconnecting said first and fourth transmission lines on said first and second input/output substrates and a second interconnecting line extending substantially across a half of said second side surface, extending up to said top surface and down to said first side surface for diagonally interconnecting said second and third transmission lines on said first and second input/output substrates.

* * * * *